United States Patent [19]

Hass et al.

[11] Patent Number: 4,832,107

[45] Date of Patent: May 23, 1989

[54] METHOD OF PRODUCING A CAST-IRON ELEMENT

[75] Inventors: Rudi Hass, Monchen-Gladbach; Georg Jansen, Eschweiler; Wilhelm Kallen, Moenchen-Gladbach, all of Fed. Rep. of Germany

[73] Assignee: Eisengiesserei Monforts GmbH & Co., Fed. Rep. of Germany

[21] Appl. No.: 132,983

[22] Filed: Dec. 15, 1987

[30] Foreign Application Priority Data

Dec. 15, 1986 [DE] Fed. Rep. of Germany ..... 3642750
Apr. 14, 1987 [DE] Fed. Rep. of Germany ..... 3712609

[51] Int. Cl.[4] ..... B22C 9/10; B22D 15/00; B22D 19/00

[52] U.S. Cl. ..... 164/98; 164/132

[58] Field of Search ..... 164/98, 132

[56] References Cited

U.S. PATENT DOCUMENTS 2,812,562 11/1957 Dalton ..... 164/132 X

FOREIGN PATENT DOCUMENTS 526740 6/1931 Fed. Rep. of Germany .
744640 1/1944 Fed. Rep. of Germany .
823644 12/1951 Fed. Rep. of Germany .
1259511 1/1968 Fed. Rep. of Germany .
2212177 9/1972 Fed. Rep. of Germany .
59-76655 5/1984 Japan ..... 164/98
61-9959 1/1986 Japan ..... 164/98
1191202 5/1970 United Kingdom .
1596442 8/1981 United Kingdom .

*Primary Examiner*—Nicholas P. Godici
*Assistant Examiner*—J. Reed Batten, Jr.
*Attorney, Agent, or Firm*—Shefte, Pinckney & Sawyer

[57] ABSTRACT

A method and apparatus for casting a cast-iron element with a non-iron interior area utilizes a molding core formed of a glass material, which may be tubular or solid and may, as desired, be entirely enclosed within the casting.

11 Claims, 1 Drawing Sheet

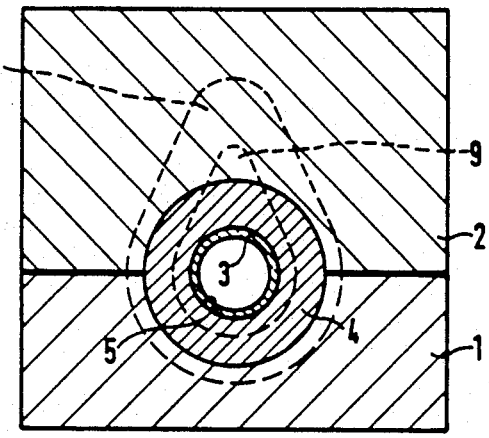
Fig.1
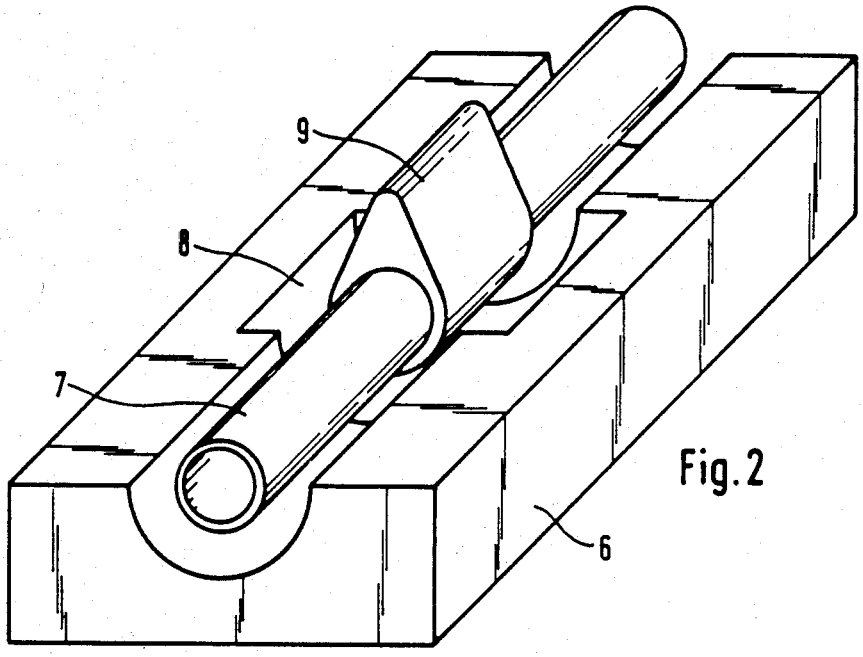
Fig.2
Fig.3
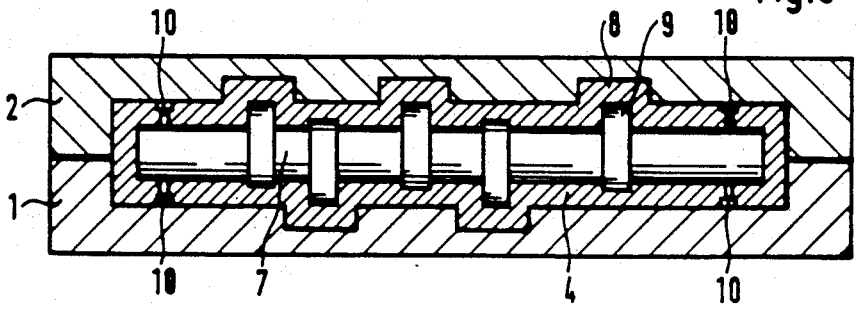

METHOD OF PRODUCING A CAST-IRON ELEMENT

BACKGROUND OF THE INVENTION

The present invention relates to an iron casting process and an iron foundry molding apparatus by which a cast-iron element having a non-iron interior area may be produced by utilizing a molding core. The invention further relates to an iron casting having a non-iron interior area. More particularly, the present invention relates to an elongate cast-iron element such as a camshaft, crankshaft or the like for internal combustion engines and to methods and apparatus for producing same.

In the casting of an elongated cast-iron component formed as a hollow body defining an elongated interior cavity, such as for example an internal combustion engine camshaft, or crankshaft, a suitable elongate core is set in the forming mold into which the molten iron is poured, thereby to form the interior cavity. Conventionally, sand cores are often utilized for this purpose, but with the disadvantage that sand cores produce a relatively rough interior surface of the casting that accordingly must be machined. Moreover, depending on the diameter and length of the core, it is often necessary to support the core at one or more locations along its length. Finally, in actual practice, sand cores have been found to fail entirely beyond a given length to diameter ratio, such as for example 500 millimeters in length and 10 millimeters in diameter.

An alternative to the use of sand cores is disclosed in British Patent No. 11 91 202 which discloses the use of a molding core assembly consisting of steel tube containing a steel bar coated with insulating material, According to this process, the steel bar is drawn out of the steel tube after molten iron has been formed in the mold about the tube whereupon it becomes a part of the casting. A fundamental drawback of this method, however, is that a quench zone forms at the interface between the steel tube and the cast iron which is very hard and difficult to bore. Furthermore, steel tubes of the type utilized in this process are relatively expensive.

An elongated casting with a relatively smoothly surfaced longitudinal interior throughole may be produced utilizing a graphite rod as the molding core, as disclosed in British Patent Specification No. 15 96 442. Disadvantageously, however, such graphite rods are relatively crack-sensitive and furthermore have a very porous surface in which moisture, grease and like residue may accumulate as a result of ordinary skin contact, which for example may lead to casting defects such as blow holes. As a result, graphite rods require special handling measures which in actual practice may be infeasible. Moreover, as with sand cores, an elongate graphite core requires the use of braces along the central zone of its length when the length to diameter ratio of the core exceeds a given value.

SUMMARY OF THE INVENTION

It is accordingly an object of the present invention to provide a process by which a hollow iron casting, particularly elongate castings such as a hollow-cast camshaft, crankshaft, or the like, may be produced. It is an additional object of the present invention to provide such a process which is suitable for casting tubular bodies having no casting openings, or tubular bodies with very small throughholes or blind holes suitable, for example, for supplying oil to bearings, or tubular bodies with a relatively large weight reducing cavity which may be cylindrical and/or conform to the outer contour of the casting. Another object of the process of the present invention is to provide the inner surface of the casting with the relatively smooth quality of a mechanical bore without requiring substantial machining. The process of the present invention also has the object of avoiding special handling requirements in a normal foundry operation.

It is another object of the present invention to provide an iron foundry molding apparatus having an elongate molding core that does not require bracing or similar support in its central lengthwise area even at relatively high length to diameter ratios of up to 500 millimeters in length to 5 millimeters in diameter. Finally, it is an object of the present invention to provide an improved hollow-cast workpiece formed of cast iron.

Briefly summarized, the present invention accomplishes the abovestated objectives by the provision of a molding core formed of a glass material. According to the method of the present invention, a cast iron element is produced with a non-iron interior area by positioning the glass molding core within a forming mold and casting a quantity of iron within the mold about the glass molding core. As desired, the casting may entirely enclose the glass molding core within the iron. As also desired, the glass molding core may be solid or may be hollow, such as a glass tube which may be closed at its ends. For example, for forming an elongate cast-iron shaft, e.g. an internal combustion engine camshaft or crankshaft, the glass molding core is preferably an elongate glass tube for positioning lengthwise within the mold to extend lenghtwise through the cast-iron shaft to be produced. When one or both ends of an elongate glass molding core are to be entirely enclosed within the iron, one or more support ring devices may be fitted about such end or ends of the glass molding core for supporting it within the mold. Preferably, the glass from which the glass molding core is formed may be of the type used in sampling pipettes for molten iron and steel, preferably of quartz material or quartz glass.

The iron foundry molding apparatus of the present invention includes a mold for casting iron and a glass molding core of the abovedescribed type compatible with the mold for disposition therein. As desired, the core may be designed to be entirely enclosed with a cast-iron product produced by the mold the mold. Preferably, the glass molding core is elongate for positioning lengthwise within the mold to extend lengthwise within the cast-iron product.

A cast-iron element produced according to the present invention has an interior area occupied by a core of glass material conforming to the interior area. As aforementioned, the core may be entirely enclosed within the interior area.

BRIEF DESCRIPTION OF THE DRAWINGS

FIG. 1 is a cross-sectional view of an iron foundry molding apparatus having an elongated molding core according to the present invention, taken transversely with respect to the lengthwise extent of the core;

FIG. 2 is a perspective view of a lower mold half and a molding core according to the present invention; and FIG. 3 is a cross-sectional view of a molding apparatus with an elongate molding core according to the present invention adapted for forming a cast-iron camshaft, taken longitudinally along the molding core.

DESCRIPTION OF THE PREFERRED EMBODIMENT

Referring now to the accompanying drawings and initially to FIG. 1, an iron-casting mold is illustrated as comprising a lower mold half 1 and an upper mold half 2 defining therebetween a molding cavity in which a cylindrical glass tube 3 is positioned as a molding core. Molten iron is poured into the molding cavity between the molding halves 1,2 to fill the cavity about the tubular glass molding core 3 to cast the molten iron as it cools and solidifies into a casting 4 conforming to the shape of the mold cavity.

It is within the concept of the present invention that different kinds of glass may be utilized for forming the molding core. Quartz material is preferred because of its relatively reduced cost, although quartz glass may also be utilized, quartz glass being produced from crystaline quartz by complete melting and degassing while quartz material, on the other hand, may be produced by partial melting or sintering of quartz sand only. Other glass types such as heretofore conventionally used in pipettes utilized for sampling molten steel or iron have also proven in practice to be satisfactory.

It is also possible to fabricate the molding core 3 to be solid glass rather than tubular. Heretofore, molding cores designed as tubes have been preferred, particularly with regard to mechanical and thermal stability. Further, the molding core 3 may be of a greater length than the casting 4 to be produced, in which case the core 3 may be braced during the casting process between the mold halves 1,2 or otherwise supported outside the outer end regions of the mold cavity. If only one end of the molding core 3 is braced in this manner outside the molding cavity, the core may be positioned within the mold cavity by means of a core brace such as in the form of an elongated rod-like thin molding core formed, for example, of steel or a like material to avoid floating of the core within the initially molten iron. The core brace will accordingly produce a correspondingly thin and elongated blind hold in the finished casting. As will be understood, if the molding core extends as aforementioned with both ends entirely out of the mold, the core will generally require no bracing within the mold cavity up to a length to diameter ratio of about 100:1, whereby an elongated glass molding core in the shape of a tube, rod or bar may be utilized to produce a casting with a correspondingly, elongated continuous non-iron interior area. Cores which exceed the aforementioned length to diameter ratio should be suitably braced centrally along their length to prevent floating in the molten iron.

As will be understood, although the softening point of the glass material used to produce the molding core 3 is generally well below the temperature of the molten iron, the casting 4 will be formed with a substantially smooth inner surface 5 corresponding to the surface quality of the glass molding core 3.

With reference now to FIG. 2, a lengthwise portion of the lower half 6 of a mold and a molding core 7 of the type used to produce an elongate shaft, e.g. a camshaft, are illustrated. As will be understood, a like upper mold half (not shown) cooperates with the lower mold half 6 to form the complete mold. As depicted, the mold half 6 is profiled, including recessed areas 8 to define essentially one-half of the mold cavity in correspondence to the desired outer shape of the casting to be produced. The molding core 7 is formed as an elongate glass tube and is provided at its otuer surface with raised portions 9 which correspond to the recessed areas 8 in the profiled surface of the mold half 6. In this manner, the molding core 7 conforms to the mold cavity defined by the mating upper and lower mold halves so that the casting produced thereby has a substantially uniform wall thickness throughout the casting.

In FIG. 3, a complete iron foundry molding apparatus similar to FIG. 2 adapted for producing an internal combustion engine camshaft is illustrated in lengthwise vertical cross-section. As will of course be understood, the present ivnention is equally adapted for producing other elongate cast-iron shafts, e.g. an internal combustion engine crankshaft, and like elongate elements. The mold includes lower and upper mold halves 1,2 defining therebetween an interior elongated mold cavity within which an elongate glass molding core 7 is positioned lengthwise and entirely enclosed. As will be understood, the mold cavity may be given any desired contour with proper account for stability, weight and other properties of the casting to be produced. To support the molding core 7 in proper disposition within the mold cavity to produce the desired interior contour to the casting to be produced, a pair of annular support rings, or chaplets, 10 are provided to annularly support the opposite ends fo the molding core 7. The chaplets 10 are preferably formed as iron rings adapted to be slidably fitted about the outer periphery of the molding core 7, with each chaplet having radially extending support legs arranged at circumferential spacings, e.g. 120 degree intervals. Alternatively, each end of the molding core 7 may be supported by three or more individual support members. In this manner, the chaplets 10, or alternative support members, support the ends of the molding core 7 in proper disposition within the mold cavity while also preventing the core 7 from floating in the molten iron during the casting process. As seen in FIG. 3, each of the lower and upper molding halves 1,2 may be provided with the recesses 8 and the molding core 7 may be provided with a corresponding arrangement of the raised portions 9 in correspondence to the desired configuration of a camshaft casting to be produced.

The molding core 7 may be constructed as a tubular glass body sealed at its opposite ends or as a solid glass body, the glass preferably being of quartz material in either case. In the casting of an internal combustion engine camshaft as depicted in FIG. 3, the incorporation of the glass molding core 7 into the casting 4 is basically for weight-reduction purposes, whereby the use of a tubular glass body as the molding core 7 is naturally favored. Nevertheless, because the specific weight of glass is relatively lower than iron, the weight of the overall casting is considerably reduced even with a solid glass body 7. As will thus be understood, the present invention as shown in FIG. 3 enables the production of a cast-iron camshaft, as well as other castings, having a defined interior non-iron area without requiring any outward hole or opening through the casting. As desired, the raised portions 9 of the molding core 7 may also be formed as glass components or in the form of a conventional sand molding core component As will of course be understood, after completion of the desired casting, it is not possible to readily determine whether the molding core 7 maintained its predetermined positioning within the molding cavity to produce a uniform casting thickness throughout the cast-iron element produced, without risking or causing damage to the finished casting. However, quality inspections may be carried out by conventional ultrasonic methods to enable the foundry to assure consistent casting quality.

For testing purposes, a molding core formed as a tubular glass body according to the present invention was sealed under standard atmospheric pressure and then positioned between the top and bottom halves of a mold by means of chaplets so as to be disposed equidistant at all points from the interior molding surfaces of the mold cavity. Following pouring and cooling of molten iron in the cavity to produce a cast iron casting, ultrasonic testing indicated that the hollow glass tube had remained unchanged in its equidistant disposition during the casting process. Further inspection was conducted after sawing open the casting and confirmed the desired structure and precise positioning of the glass tube within the casting.

As will thus be understood, the present invention provides a casting process and molding apparatus which enables iron foundries to cast an elongated cast-iron workpiece such as a camshaft or other desired element as a tubular body with a central solid or tubular glass core, without requiring substantial machining of the inner contour of the casting and without producing quench layers or the like in the casting that are difficult to bore. The present process and molding apparatus utilizing a glass tube as the molding core are particularly well suited for producing a camshaft which is relatively thin for its length but which has a longitudinal bore extending partially or completely therethrough to reduce weight and/or to provide an oil supply conduit. Those persons skilled in the art will also recognize that, following the pouring and cooling of a casting produced in accordance with the present invention, any glass remaining in the hollow-cast throughhole, blind hole or the like, may be eliminated by conventional techniques such as those used to remove sand cores, particularly by simple boring, vibration, blasting or high-pressure water application. On the other hand, removal of the glass molding core after casting is completed is not always necessary or desirable when the core is completely enclosed within the casting, as depicted in FIG. 3. Such a casting with a cavity enclosed on all sides will be particularly advantageous if only a weight reduction is desired or if the casting is to have quite defined blind holes which cannot be produced with sufficient precision through pouring and are to be produced later by means of a borer with no pour hole interference. In these cases, if the borer does not reach as far as or pierce the glass core, it is generally not necessary to remove the glass.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of producing a cast-iron element having a non-iron interior area, said method comprising the steps of providing a forming mold, positioning a molding core of a glass material within said mold, and casting a quantity of iron within said mold to entirely enclose said glass molding core.

2. A method of producing an elongate cast-iron shaft having an elongated non-iron interior area, such as a camshaft, crankshaft or the like of the type for use in an internal combustion engine, said method comprising providing a shaft forming mold, positioning a molding core of a glass material within said mold, and casting a quantity of iron within said mold about said glass molding core.

3. A method according to claim 1 or 2 and characterized further in that said glass molding core is an elongate glass tube and said positioning step includes positioning said glass tube lengthwise within said mold to extend lengthwise through the cast-iron product produced.

4. A method according to claims 1 or 2 and characterized further in that said glass molding core is hollow.

5. A method according to claim 4 and characterized further in that said glass molding core is a glass tube closed at its ends.

6. A method according to claim 2 and characterized further in that said casting step includes enclosing said glass molding core entirely within said iron.

7. A method according to claim 1 or 2 and characterized further in that said glass molding core is solid.

8. A method according to claim 1 or 2 and characterized further in that said positioning step includes fitting at least one support ring means about said glass molding core for supporting said glass molding core within said mold.

9. A method according to claim 1 or 2 and characterized further in that said glass molding core is formed of glass of the type used in sampling pipettes for molten iron and steel.

10. A method according to claim 1 or 2 and characterized further in that said glass molding core is formed of quartz glass.

11. A method according to claim 1 or 2 and characterized further in that said glass molding core is formed of quartz material.

* * * * *